United States Patent [19]

Miller

[11] 4,259,036

[45] Mar. 31, 1981

[54] HOPPER CAR DOOR LOCKING ARRANGEMENT

[75] Inventor: Roy W. Miller, Highland, Ind.

[73] Assignee: Pullman Incorporated, Chicago, Ill.

[21] Appl. No.: 57,529

[22] Filed: Jul. 13, 1979

[51] Int. Cl.[3] ..... B61D 7/30

[52] U.S. Cl. ..... 414/388; 105/241.2; 105/290

[58] Field of Search ..... 414/376, 387, 388; 105/241.1, 241.2, 286, 288–290, 292, 306

[56] References Cited

U.S. PATENT DOCUMENTS

| | | | |
|---|---|---|---|
| 2,621,809 | 12/1952 | Linville | 414/387 |
| 2,728,471 | 12/1955 | Jones | 414/387 |
| 3,446,374 | 5/1969 | Miller | 105/290 X |
| 3,596,608 | 8/1971 | Aquino et al. | 105/286 X |
| 3,773,194 | 11/1973 | Schuller | 105/290 X |

*Primary Examiner*—Andres Kashnikow

*Attorney, Agent, or Firm*—Richard J. Myers; Stephen D. Geimer

[57] ABSTRACT

A hopper car door locking and unlocking arrangement includes a crank arm which is initially moved to a bail engaging position laterally outwardly of the car and then is further operated by the bail of a side of track door opening device. The crank arm moves a longitudinal actuating means which controls the locking members of a pair of downwardly opening hopper doors.

15 Claims, 6 Drawing Figures

69
70
74
73
81
16
77
75
72
60
61
63
68
65
67
64
17
62
59
55
55
54
56
14
14
33
29
57
48
58
53
52
47
46
14

54
55
59
57
55
58
57
56
49
48
52
53
50
14
33
46
47'
51
46
47
46'

HOPPER CAR DOOR LOCKING ARRANGEMENT

BACKGROUND OF THE INVENTION

1. Field of the Invention

The field of invention covers hopper cars having downwardly and outwardly hinged discharge doors. More specifically, the invention related to an improved door locking and unlocking arrangement which is actuated from side of track camming devices positioned adjacent to a pit of dumping site.

2. Description of the Prior Art

The railway art is replete with hopper car doors which include latching devices engageable with tripping mechanisms provided by the side of the track for unlocking hopper car doors for dumping. Such devices are shown in U.S. Pat. Nos. 2,621,809, Dec. 16, 1952; 2,728,471, Dec. 27, 1955 and 3,165,213 dated Jan. 12, 1965. In these devices tripping arrangements are provided by the side of the track and as the cars reach the tripping devices, suitable linkage means engages an unlocking mechanism, unlocking the car doors so that the load is dumped. In the present invention, broadly, it is the side-of-track devices that control the locking mechanism provided on the car. In the present invention, a unique and distinctive arrangement is provided which permits the unlocking and locking of the mechanism of the car doors in two stages. The initial stage provides for the outward movement and actuation of a crank arm which is then positioned away from the car and is subsequently engaged by a bail member which pulls the crank arm and a longitudinally actuating member into a position whereby the doors are unlocked. A crank arm on the other end of the car also is positioned and is actuated in similar manner to again provide for locking of the doors.

SUMMARY OF THE INVENTION

The hopper car of the present invention is provided with inner and outer doors which move downwardly to an open position. The doors are of a type which are suitably interconnected by linkage so that the doors both move in concert or conjointly. The inner door of each hopper includes a laterally extending camming bar or arm which is provided with a cam follower. The center sill of the car includes a plurality of longitudinally spaced guides which support a rectangular tube positioned on the guides for longitudinal movement. The tube is the actuating member and includes a cam which in one position is positioned against the cam follower of the cam arm and prevents the doors from moving to their open position. In effect, then, this is the lock which is provided for the doors in a closed position. In order to move the doors to the open or unlocked position the longitudinal tube is displaced so that the cam moves out of camming engagement with respect to the cam follower of the arm and whereupon the door then can by gravity with the load contained therein move to the open position. The present invention is particularly concerned with the actuating mechanism which moves the tube longitudinally between the open and locked position of the doors.

The longitudinal tube is provided at opposite ends with clevises which are connected to bell crank levers mounted on opposite ends of the railway car underframe. The bell cranks in turn are connected by suitable linkage to a flexible chain element which extends laterally and is connected to crank arms positioned at the opposite ends and on opposite sides of the car, respectively. The crank arms, at opposite sides of the car, are pivotally mounted and are substantially within the clearance requirements of the A.A.R. The crank arms which are connected to the chain elements are kept in a relatively taut relation by a slack adjuster. Each of the crank arms also has associated therewith an actuating link which is pivotally mounted and which has at one end a push pad adapted to be engaged by the cam of a side-of-track camming device. The link is engaged within the socket or recess of the crank arm and when the same is engaged by the cam member of an off-track camming device the push pad moves the crank arm to rotate in a counterclockwise manner wherein a finger of the crank arm is moved to an initial outward position. The side-of-track camming device also includes a bail member which now engages the finger of the crank arm and as the car is moving along the track, the crank arm is moved further outwardly and in so doing the chain actuates the linkage arrangement to longitudinally move the actuating bar which in turn moves the camming device free of the followers of the door arm and whereupon the doors are moved to the open position. The crank arm positioned at the other end of the car is nonfunctional at this point. However, as the car travels further on the track beyond the pit a similar camming device is positioned to actuate the crank arm which in turn moves the actuating member or tube in an opposite direction again causing the cam on the actuating tube to be disposed against the cam follower and thus locking the doors in the closed position.

BRIEF DESCRIPTION OF THE DRAWINGS

FIG. 1 is a side elevational view of a railway car and side-of-track camming devices;

FIG. 2 is a plan view of the track and associated side-of-track camming devices;

FIG. 3 is a plan view of a side-of-track door opening arrangement with a portion of the railway car disclosing the crank arm and its operative relation to the said mechanism;

FIG. 4 is a view similar to FIG. 3 showing the engagement of a crank arm with the bail of a door opening mechanism;

DESCRIPTION OF THE PREFERRED EMBODIMENT

Figure 5:
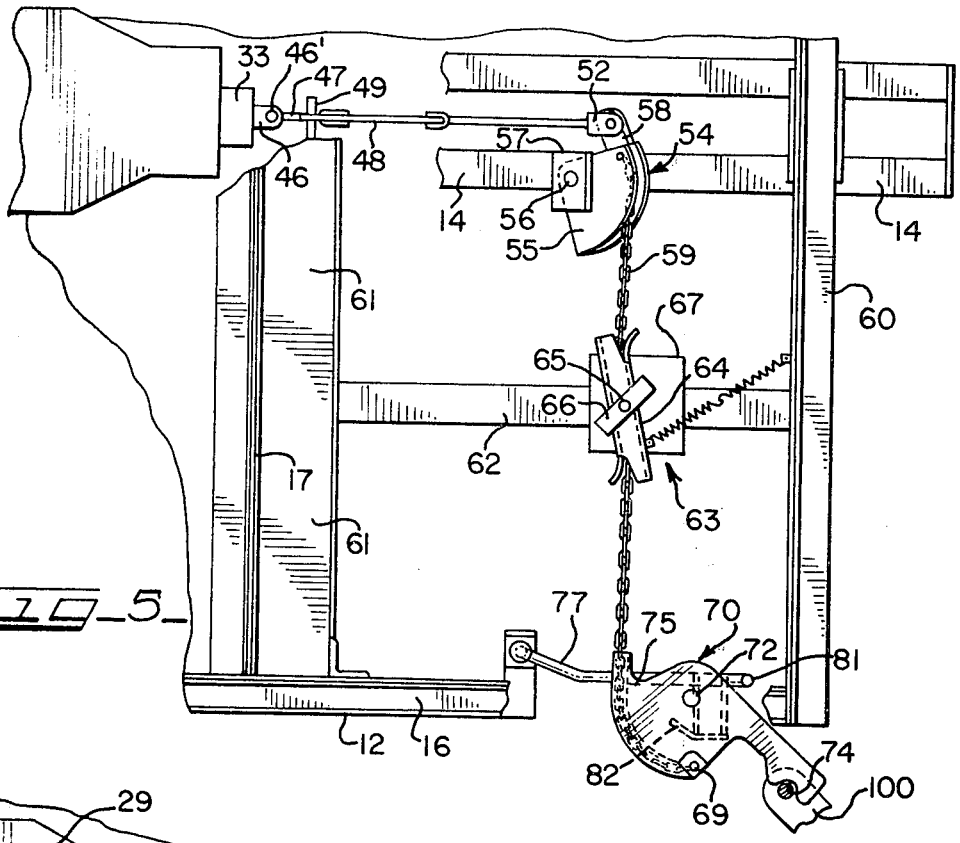
FIG. 5 is a sectional view in plan of a rear portion of the railway car showing the crank arm moved to a fully door opening or unlocking position.

FIG. 1 discloses a railway hopper car 10 supported on track rails 10A the said car including a body 11, side walls 12 and an underframe 13. The underframe 13 is of a standard construction including an elongated center sill 14 which is supported by suitable bolster and cross-bearer means (not shown) supported on wheel trucks 15 of conventional construction.

Figure 13:
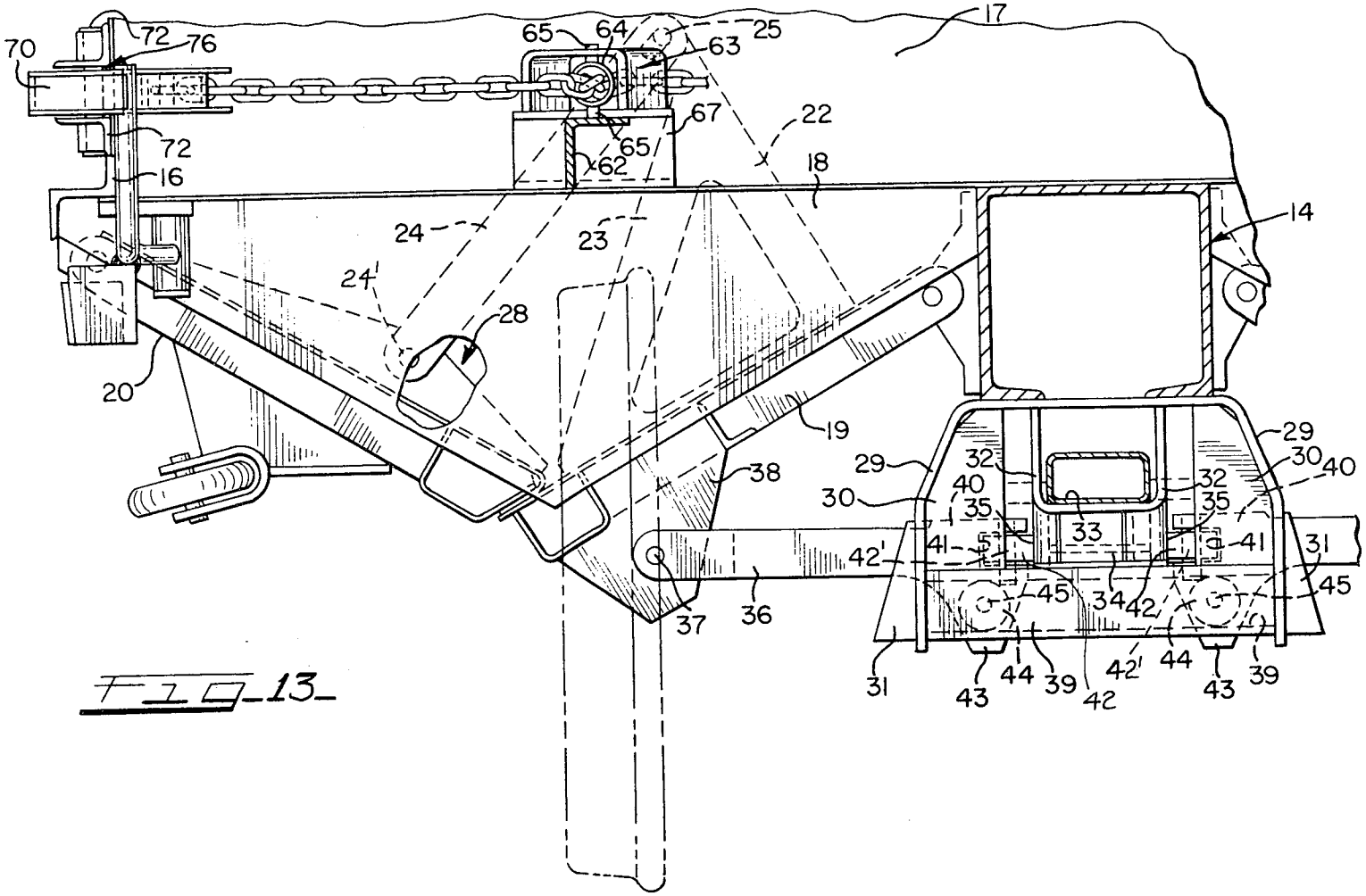
FIG. 13 is a cross-sectional view of a door locking arrangement taken substantially along the line 13—13 of FIG. 1.

The railway hopper car 10 includes side sills 16 as best shown in FIG. 13 and may include a plurality of hoppers 26 having vertical dividers 17 and as best shown in FIG. 13, a lower vertical extension 18. The hoppers 26 may be of conventional design having lower discharge openings 28 from which the load is generally dumped into bins or pits disposed beneath the track. An inner door 19 and an outer door 20 is hingedly connected to the side sills 16 by means of hinge brackets 21 as schematically indicated in FIG. 1. As best shown in FIG. 13 the doors are interconnected by means of a rigid arm 22 secured to the door 19 and a diagonal arm 23 connected to the door 19 and to the arm 22. A link 24 is pivotally connected at 25 to the arm 23, the said link 24 also being pivotally connected to the door 20 by means of a pivot 24'. Thus the doors are movable in a conjoint manner to their open and closed positions. In FIG. 1 the hoppers, generally designated at 26, includes sloping end walls 27. Details of the hopper structure are not further described since they form no part of the present invention.

In FIG. 13, only one set of doors is disposed on one side of the car. In the car disclosed, however, there are two sets of longitudinal doors disposed on opposite sides of the car. In other words, there are four discharge openings and four sets of doors for dumping the load from the hopper car. Thus FIG. 13 primarily shows one set of doors. An inverted U-shaped plate 29 is rigidly connected to the center sill 14 and projects downwardly therefrom. The plate 29 has internal vertical gussets 30 rigidly connected thereto. Door bumpers 31 are rigidly secured to the outer portions of the U-plate 29. A plurality of U-shaped hangers 32 are rigidly secured to the plate 29 and project downwardly therefrom. These support a longitudinally extending rectangular slide tube 33 or actuating member. The tube 33 has ridigly connected thereto for movement therewith a wedge or cam member 34 which is provided with laterally spaced outer vertical cam surfaces 35. The inner door 19 includes a slide arm 36 which is as indicated at 37 pivotally connected to a bracket 38. A channel guide 39 is rigidly connected to the U-plate 29 and extends completely across the extent of the said plate. The end of each arm 36 is provided with an enlarged clevis type member 40 having suitable slots 41 within which cam follower wheels 42 are rotatably supported by means of pivot shafts 42'. The ends of the arms 36 also include lower guide projections 43 having guide wheels roatatably journaled thereon by means of pivot shafts 45. The wheels 44 are guided in the channel shaped guide brackets 39 so that during the opening movement of the doors 19 the slide arms 36 move past each other completely to the opposite ends of the channel guide 39.

Figure 6:
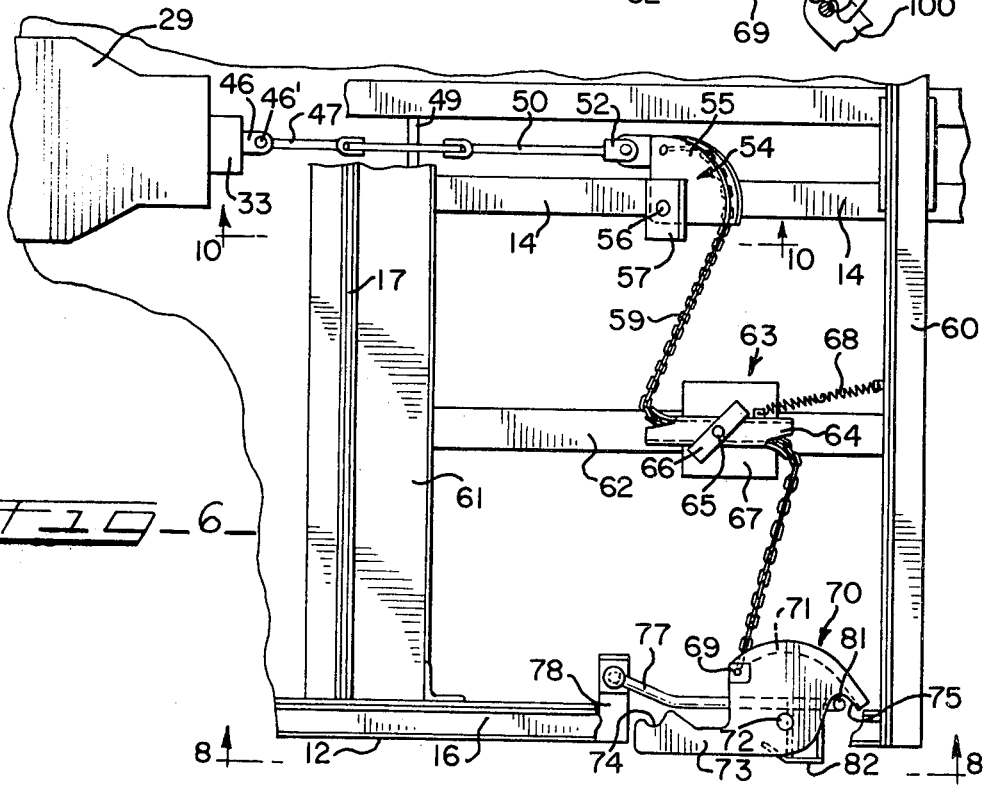
FIG. 6 is a similar view to FIG. 5 showing the crank arm in a closed non-actuated position.
Figure 9:
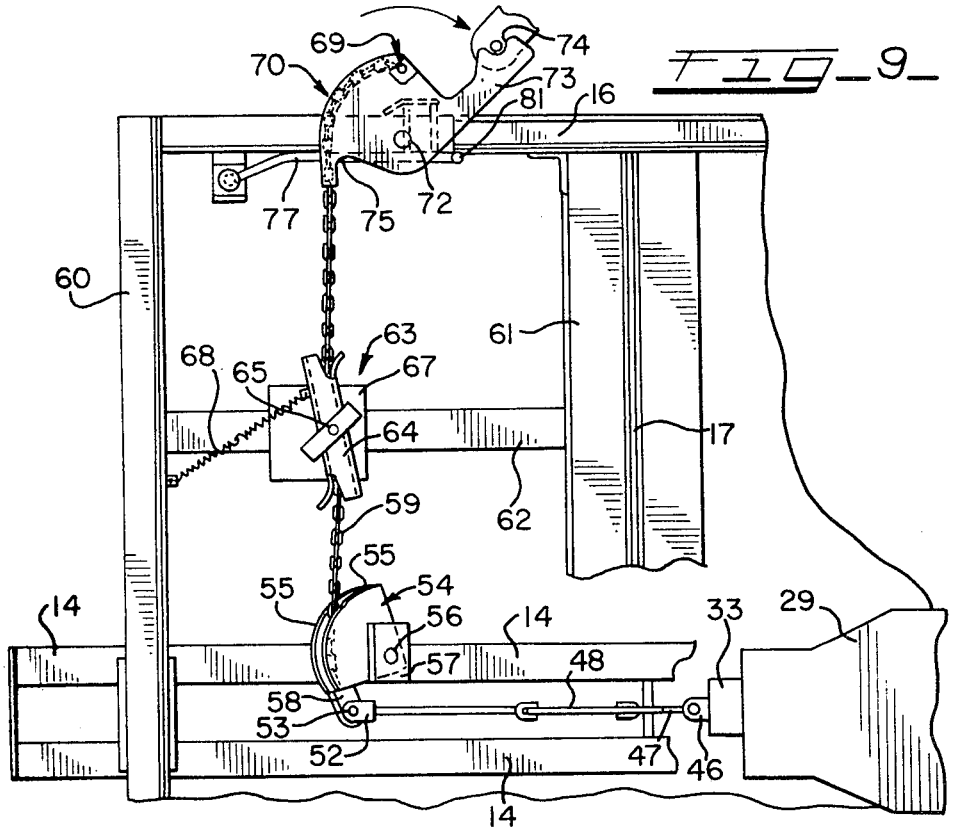
FIG. 9 is a view similar to FIG. 6 showing an opposite end of the railway car with an associated crank arm mechanism.
Figure 10:
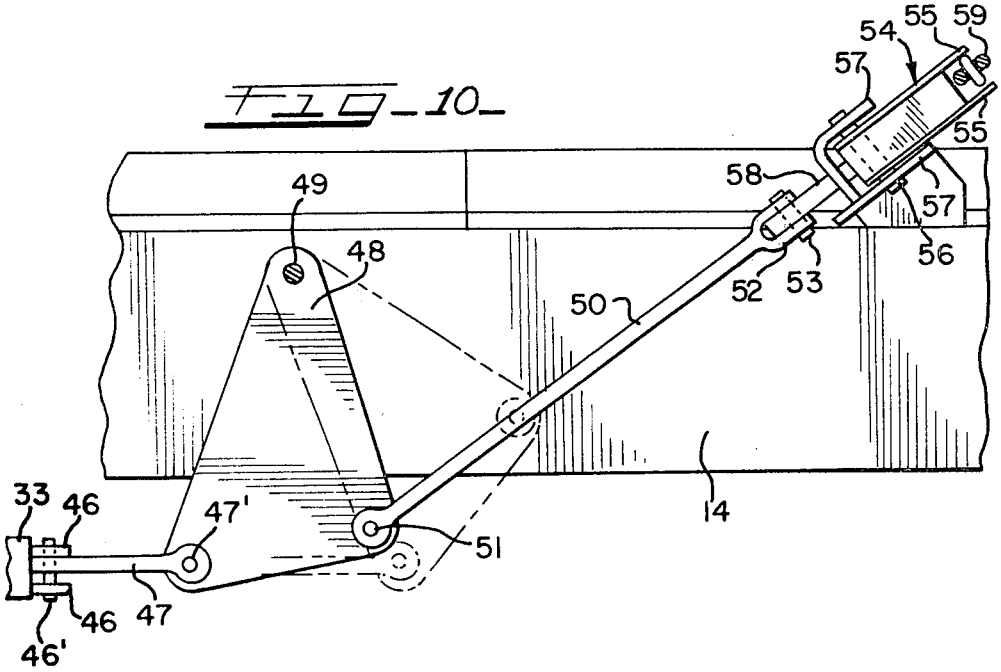
FIG. 10 is a cross-sectional view along the line 10—10 of FIG. 6.

As best shown in FIGS. 5, 6, 9 and 19 the actuating member or tube 33 includes pivot ear portions 46 pivotally connected as indicated at 46' to link 47 in turn connected as indicated at 47' pivotally to a bell crank 48 which is pivoted to the center sill 14 by pivot means 49 as indicated in FIG. 10. The link 50 is suitably pivoted as indicated at 51 on the bell crank and includes a clevis 52 pivotally connected as indicated at 53 to a pivotal motion transferring member 54. The member 54 includes a pair of spaced plates 55 suitably connected together and including a pivot member 56 which is connected to pivot brackets 57 rigidly secured to the center sill 14. The clevis 52 is connected to a pivot finger 58 by the pivot 53 and thus pivotal movement of the member 54 provides for longitudinal movement of the link 50 and rotation of the bell crank lever 48. A chain 59 is connected to the member 54 and extends laterally. The side sills 16 as best shown in FIGS. 5, 6 and 9 are connected at the opposite ends of the car by transversely extending end cross members 60. A transverse cross member 61 adjacent to the divider 17 also is connected at opposite ends to the side sills 16 and to the center sill 14. As shown in these views the transverse cross member 61 also has connected thereto a longitudinally extending beam member 62 also suitably connected to the end cross members 60.

Figure 8:
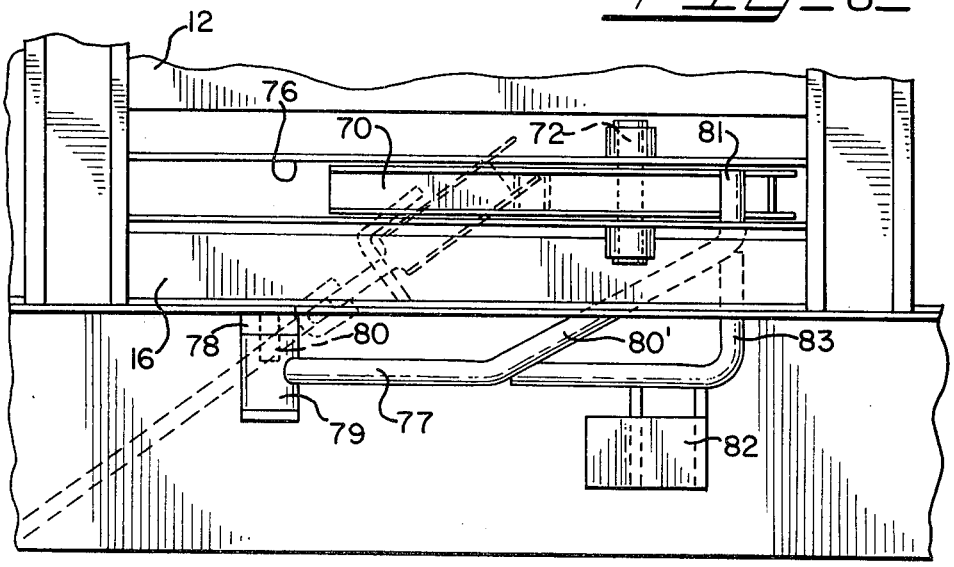
FIG. 8 is a side elevational view of a crank arm and link arrangement taken substantially along the line 8—8 of FIG. 6.

A chain tightener 63 is suitably connected to the chain 59. The chain tightener 63 is supported on the beam 62 and includes a tubular guide 64 through which the chain extends and pivot means 65 pivotally connected to an inverted U-shaped member 66 and a pivot bracket 67 provides for pivotal movement of the tube 64. A spring 68 is suitably connected to the tube 66 and the cross member 60. The chain 59 extends from the tube 64 to a connection 69 provided on a crank arm 70. The crank arm 70 includes a groove 71 which is adapted to receive the chain and a pivot 72 supports the crank arm 70 on the side sill 16. The crank arm 70 includes a finger 73 having a bail engageable notch 74. The other end of the crank arm includes a socket 75. As best shown in FIG. 13 the crank arm is movable through an opening 76 provided in the side wall 12 of the car. As best shown in FIGS. 5, 6 and 8 an arm or link 77 is pivotally supported on a bracket 78 by means of a sleeve 79 connected to a pivot 80 so that the link 77 may be swung horizontally about a vertical pivot. As best shown in FIG. 8, link 77 includes a diagonal portion 80' and is provided with an upper end portion 81 adapted to be disposed in the socket as best shown in FIG. 6. As shown in FIG. 8 a push pad 82 is rigidly connected to a bracket 83 in turn connected to the link 77.

Figure 7:
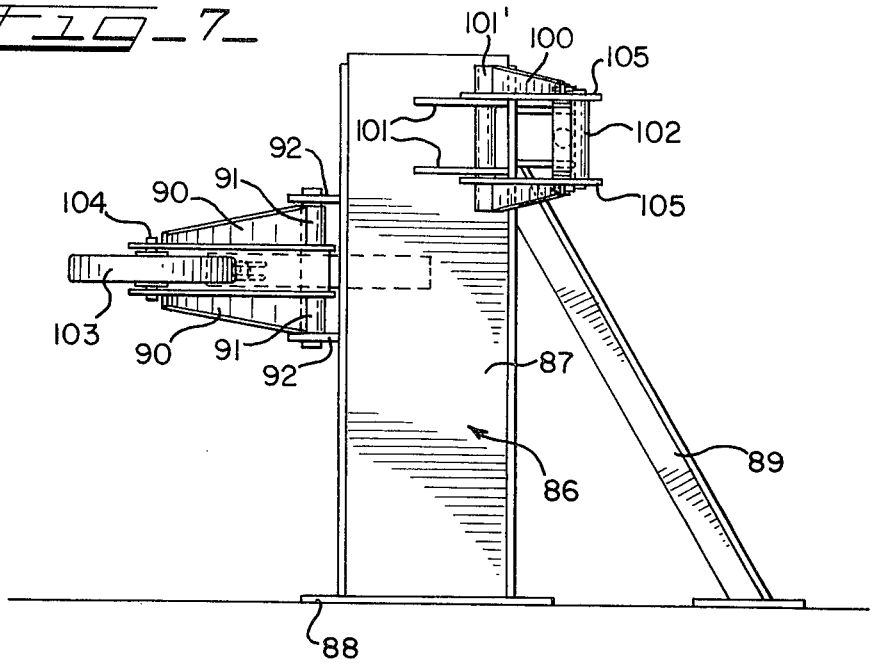
FIG. 7 is an elevational view taken substantially along the line 7—7 of FIG. 3.

As best shown in FIG. 2 a side-of-track door opening mechanism is generally indicated at 84 and a door closing mechanism on the other side of the track is generally designated by the reference character 85. As best shown in FIG. 7 the door opening mechanism includes a pedestal 86. Both the closing and opening mechanism are of identical construction and therefore the same reference characters will apply. The pedestal 86 comprises a plurality of plates 87 suitably welded into a box section and seated upon a base 88. A brace 89 further supports the base 88 on the ground to which it is rigidly connected. Pivot levers 90 are suitably connected for pivotal movement about vertical pivot shafts 91 pivotally supported on support brackets 92 projecting from the pedestal 86. As best shown in FIGS. 3 and 4 the biasing arrangement includes a spring 93 which is held captive against a stop 94 supported on a rod 95. The rod 95 includes a pivot 96 connecting the same to the pivot lever 90. An angle bracket supports the other end of the rod 95 which extends therethrough and is suitably retained thereon by means of a nut 98. The rod 95 can move through the bracket 97 against the spring 93. On the other side of the pedestal 86 a similar spring arrangement 93, stop 94, rod 95 and nut 98 is supported on a bracket 99 extending outwardly from the pedestal. The rod is pivotally connected as indicated at 96 to a bail 100 which is pivotally supported on brackets means 101 on the pedestal by means of pivot 101'. An actuating pin 102 at the upper end of the bail 100 is adapted to engage the slot or notch 74 provided in the end of finger 73 as best shown in FIG. 4. A cam follower wheel 103 is suitably journaled on the arm 90 by means of a shaft 104 as best shown in FIG. 7. Also as best shown in FIG. 7 the bail 100 includes space plates 105 which support the actuating pin 102. As best shown in FIG. 1, the outer doors 20 are provided with outwardly extending bracket and roller arrangements 106 which are adapted to engage a door closing mechanism to be described.

Figure 11:
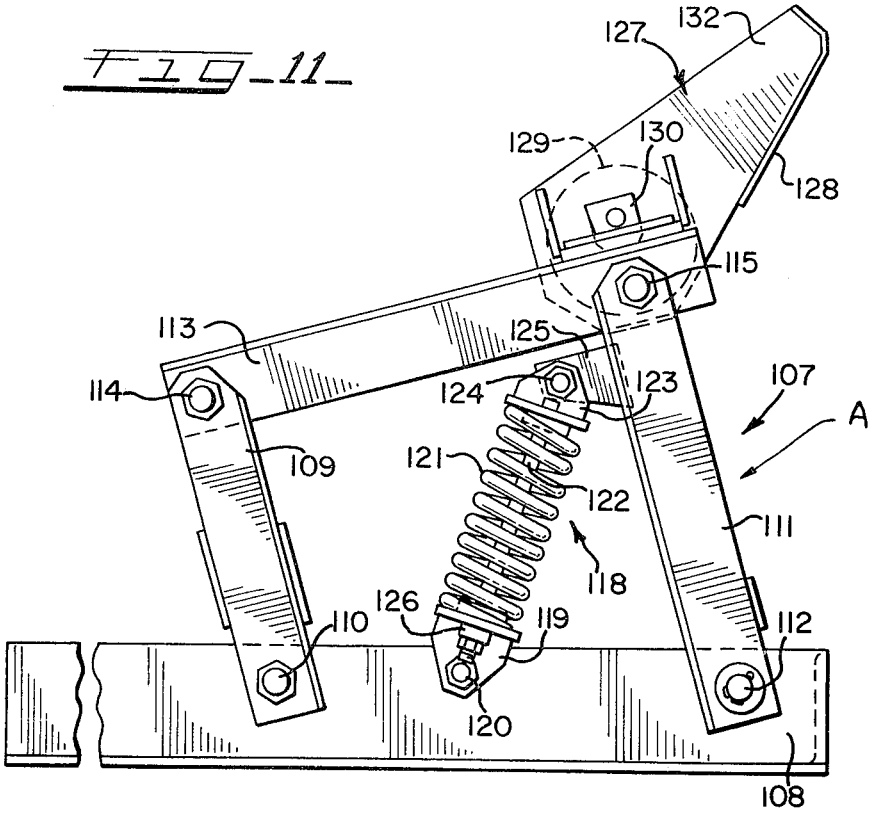
FIG. 11 is a side elevational view of a door closing cam arrangement taken substantially along the line 11—11 of FIG. 2.
Figure 12:
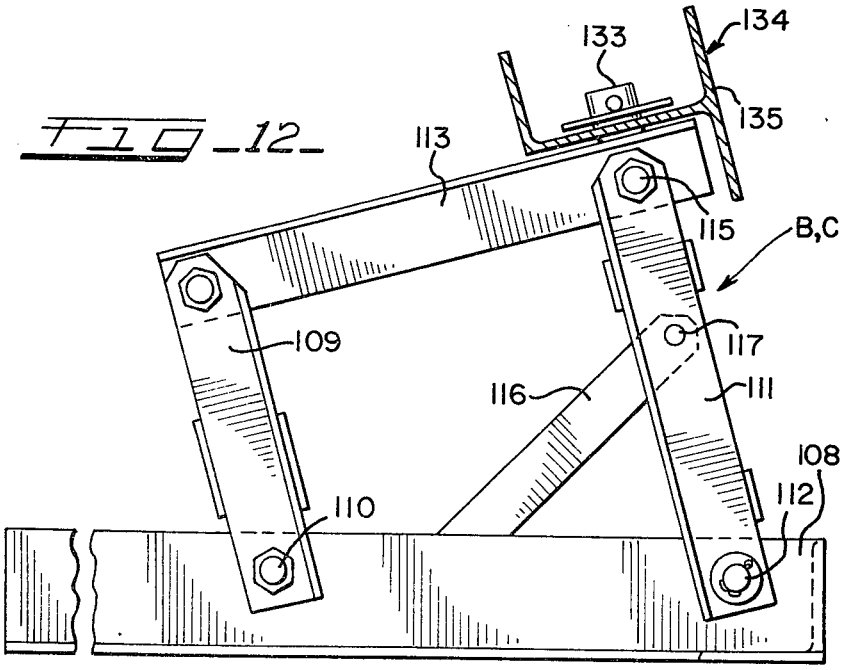
FIG. 12 is a cross-sectional view taken along the line 12—12 of FIG. 2.

A door closing mechanism generally designated at 107 is best shown in FIGS. 2, 11 and 12. The door closing mechanism 107 includes three support structures A, B and C, each of which includes base members 108 to which a rear support angle 109 is connected by means of connection 110. The front support 111 is connected to the angle 108 by means of a pin 112. A diagonally extending member 113 is connected to the member 109 by means 114 and at its forward end by connecting means 115. To this extent the support structures A, B and C for the closing mechanisms 107 shown in FIGS. 11 and 12 are identical. However the support structure C shown in FIG. 12, as well as structure B, each includes a rigid link 116 rigidly connecting the member 111 and member 108 by means of the connection 117, the said link 116 being welded to the base member 108. Thus the arrangement shown in FIG. 12 (support structures B and C) are rigid whereas the support structure A shown in FIG. 11 is flexible in that the spring tensioning device 118 permits the members 111, 109 and 113 to pivot about the lower connections 112 and 110. The device includes a bracket 119 pivotally connected as indicated at 120 to the lower member 108. A spring 121 is supported on a rod 122 which slides through the bracket 119. The upper end of rod 122 is rigidly connected to a bracket 123 which is pivotally supported at 124 on a bracket 125 rigidly connected to the member 111. Thus the structure shown in FIG. 11 may be rocked or moved about the pivots 110 and 112 restrained by the flexible or tensioning mechanism which resiliently biases the same position shown in FIG. 11. A camming member 127 extends between and is connected to the supporting members A and B. The camming member 127 includes a scrolled camming surface 128 in turn connected to a torque tube structure 129 by connecting plates 132 and pivotally connected as indicated at 130 to the structure shown in FIG. 11. The tube 129 is also connected pivotally as indicated at 133 to the structure B shown in FIG. 12. As best shown in FIG. 2 the closing mechanism 107 includes a rigid portion 134 having a straight cam face 135 as best shown in FIG. 12. As best shown in FIG. 2 the support structure A disclosed in FIG. 11 is provided at one end of the camming mechanism. The other end support structure C shown in FIG. 12 is provided at the opposite ends of the complete camming mechanism. An intermediate support structure B is provided which is rigid like structure C whereas the support structure A is flexibly positioned so that a certain amount of movement is resisted by the spring as the rollers 106 on the doors initially engage the camming device.

Operation

As the car moves into the position shown in FIG. 1 the doors are in the closed locked position shown in FIG. 13 and the crank arms 70 at opposite ends of the car are in the position as shown in FIG. 6. The roller 103, as the car is moving, engages the push pad 82 which pivots the link 77 from the position shown in FIGS. 3 and 6 to the position shown in FIG. 4 wherein the crank arm is positioned partially outwardly with the finger 73 in position to be engaged by the bail 100. As the pin 102 engages the notch 74 as shown in FIG. 4 the bail 73 is further moved to the position shown in FIG. 5 which causes the chain 59 to pull laterally whereupon the chain tightener assumes the position shown in FIG. 5 and the link 48 is moved longitudinally to pivot the bell crank lever. The bell crank lever then pulls on the tube 33 moving the same in a longitudinal direction thereby displacing the cam 34 from engagement with the rollers 42 so that the doors now can open. The arms 36 move laterally in crossing relation as the doors move downwardly by gravity and the load is discharged. In other words, the cam 34 is moved longitudinally with the tube 33 to an out of the way position relative to the rollers 42 whereupon the doors become unlocked and the arms 36 are free to move in side by side and crossing relation releasing the doors for full dumping action.

The car continues to move and the crank arm 70 at the other end of the car is in the same position as the crank arm in FIG. 6. As the car moves along the door closing cam mechanism, the rollers 106 engage the camming members 127 which swing the doors to a closing position. The door locking mechanism 85 (which is identical to the door opening mechanism 84) now functions in a manner wherein the roller 103 engages the push pad, whereupon the link 77 is moved in the socket 75 to push the crank arm 70 partially outwardly. Continuing movement of the car provides for engagement of pin 102 of the bail in the notch 74 whereupon the crank arm, as indicated in FIG. 9, is moved to actuate and move the longitudinal actuating member in a reverse direction back to the locking position disclosed in FIG. 13.

The arms are now again fully locked and the crank arms are in their locked and recessed position.

What is claimed is:

1. For a railway hopper car having an underframe, and a body supported to said underframe including a plurality of hoppers each having a discharge opening, a pair of downwardly and outwardly swinging inner and outer doors supported on said underframe for opening and closing each opening, a door locking arrangement including a bracket structure supported on said underframe, an arm connected to said inner door, means slidingly supporting said arm on said bracket for lateral movement, a longitudinally movable actuating member slidingly supported on said bracket structure, said actuating member having a cam surface, cam follower means on said arm engaging said cam surface in one position for locking said doors in a closed position and said actuating member being longitudinally movable to release said follower means and doors from said locked position, the improvement of a door actuating arrangement comprising a crank arm, means movably mounting said crank arm on said underframe, a tension member connected to said crank arm, said tension member extending laterally of said car and longitudinally, means connecting said tension member to said longitudinal actuating member;

a ground supported door opening mechanism including a vertical pedestal, a thrust cam movably supported on said pedestal, said thrust cam being movable to initially move said crank arm laterally outwardly from said car as said hopper car is passing adjacent to said opening mechanism thereby providing tension in said tension member and moving said crank arm to a bail engageable position, and a bail member positioned on said pedestal, said bail member engaging said crank arm to move the same thereby moving said actuating member to release said doors from locking engagement.

2. The invention in accordance with claim 1, said crank arm being pivotally connected to said car and including a finger during initial pivoting movement of said crank arm projecting outwardly laterally from said car, and said bail engaging said finger thereby futher rotating said crank arm to release said doors.

3. The invention in accordance with claim 2, said tension member including a flexible portion connected to said crank arm, and linkage means connected to said flexible member and to said longitudinal actuating member.

4. The invention in accordance with claim 3, said linkage means including means transferring lateral tension from said flexible member to longitudinal tension, and a bell crank lever pivotally mounted on said car connected to said linkage means and said longitudinal actuating member.

5. The invention in accordance with claim 1, including a cam receiving member associated with said crank arm, and said cam receiving member including a push pad engaged by said thrust cam to move the crank arm to said bail engageable outward position.

6. The invention in accordance with claim 5, said cam receiving member including a pivoted link supported on said underframe, a socket on said crank arm engaged by said link in a closed position of said crank arm, said push pad being supported on said link, whereby movement of said push pad in response to engagement by said thrust cam actuates said link for pivotal movement thereby moving said crank arm whereupon said pivoted link is disengaged from said socket.

7. The invention in accordance with claim 1, said tension member including a flexible tension element connected to said crank arm, and slack adjusting means included in said flexible tension element.

8. The invention in accordance with claim 7, said flexible tension member including longitudinally movable linkage means connected to said actuating member and said flexible tension element.

9. The invention in accordance with claim 1, said inner and outer doors including linkage means interconnecting the same to provide for cojoint movement.

10. The invention in accordance with claim 1, said thrust cam and said bail member including biasing means biasing said thrust cam and said bail member into engagement with said crank arm.

11. The invention in accordance with claim 1, including a side of track closing mechanism including a camming device mounted on each side of said track, and cam follower means on an outer surface of each door engaging said camming devices for swinging said doors to a closed position as said railway car is moved adjacent said closing mechanism.

12. The invention in accordance with claim 11, said camming devices each including a cam surface converging longitudinally relative to a track on which said railway car is moving.

13. The invention in accordance with claim 12, said camming device each including a first end support connected to one end of said camming device, and biasing means on said first end support resiliently positioning said first end support and can surface for limited lateral movement relative to a car mounted on a track adjacent thereto.

14. The invention in accordance with claim 13, including a second end support, and means pivotally connecting said camming device to said second end support for pivotal movement about a vertical axis.

15. The invention in accordance with claim 1, said inner and outer doors including linkage means interconnecting the same for conjoint movement, said crank arm being mounted on said underframe adjacent one end of said car, a second crank arm mounted adjacent the other end of said car, a second tension member extending laterally and longitudinally and being connected to said second crank arm, second means connecting said second tension member to said longitudinal actuating member, said first ground supported door opening mechanism being supported on one side of a track, a second ground supported door opening mechanism including a second pedestal supported on the other side of said track and longitudinally spaced from said first door opening mechanism, a second thrust cam movably supported on said second pedestal and being movable to initially move said second crank arm laterally outwardly to a bail engageable position, and a second bail on said second pedestal engaging said crank arm to move said actuating member in locking engagement.

* * * * *